US005204993A

United States Patent [19]

Siemens

[11] Patent Number: 5,204,993

[45] Date of Patent: Apr. 27, 1993

[54] GOALIE CHEST PAD

[76] Inventor: Victor Siemens, 1310 Gulleden Drive Unit #11, Mississauga, Ontario, Canada, L4X 1Y9

[21] Appl. No.: 867,485

[22] Filed: Apr. 13, 1992

[51] Int. Cl.[5] ..... A41D 13/00

[52] U.S. Cl. ..... 2/2; 2/44; 2/45; 2/16; 2/267; 2/268

[58] Field of Search ..... 2/2, 44, 45, 16, 267, 2/268

[56] References Cited

U.S. PATENT DOCUMENTS

| | | | |
|---|---|---|---|
| 3,509,579 | 5/1970 | Morgan | 2/2 |
| 3,528,106 | 9/1970 | Austin | 2/2 |
| 3,867,726 | 2/1975 | Owl et al. | 2/2 |
| 4,425,667 | 1/1984 | Harrison | 2/2 |
| 4,516,273 | 5/1985 | Gregory et al. | 2/2 |
| 4,590,622 | 5/1986 | Wolfe et al. | 2/2 |
| 4,694,505 | 9/1987 | Flosi et al. | 2/2 |
| 4,698,845 | 10/1987 | Cosby | 2/2 |
| 4,821,339 | 4/1989 | Fair | 2/2 |
| 4,825,476 | 5/1989 | Andrews | 2/2 |
| 4,868,925 | 9/1989 | Mitchell | 2/2 |
| 4,982,447 | 1/1991 | Henson | 2/44 |
| 4,989,265 | 2/1991 | Nipper et al. | 2/2 |
| 4,996,720 | 3/1991 | Fair | 2/2 |
| 5,007,108 | 4/1991 | Laberge et al. | 2/2 |
| 5,029,341 | 7/1991 | Wingo, Jr. | 2/2 |
| 5,060,313 | 10/1991 | Nellhalfen | 2/2 |
| 5,065,457 | 11/1991 | Henson | 2/2 |
| 5,129,101 | 7/1992 | Douglas | 2/2 |

*Primary Examiner*—Clifford D. Crowder
*Assistant Examiner*—Gloria Hale

[57] ABSTRACT

The present invention provides a sports useable body protector primarily for use as a chest protector and comprising a rigid frame with forward padding and a rearward suspension strap on the frame. The rigid frame is formed with rearwardly extending wrap around rib covering portions and wrap over collar bone and shoulder covering portions all of which are shaped to pull the rigid frame rearwardly when worn by a user such that the suspension strap is snug against the user with the rigid frame in a tight body fitting position.

3 Claims, 5 Drawing Sheets

33
37
31
31
35
25
27

23
41
33
39
37
36
31
29
31
35
33
27
29
39

36
35

GOALIE CHEST PAD

FIELD OF THE INVENTION

The present invention relates to a body protector for use in sports and is primarily used as a goalie chest protector.

BACKGROUND OF THE INVENTION

Body protectors, and in particular chest protectors, are useable in different sports. The most widely used of these protectors is a goalie chest protector for hockey.

There are presently available many different types of body and/or chest protectors. However, those that are available are generally very bulky in nature and awkward to wear because of the thick padding required. These cumbersome protectors are loose fitting which inhibits movement of the person wearing the protector. Furthermore, most protectors tend to cover little more than the chest region leaving other areas of the body vulnerable which is a particular problem in hockey where the puck can easily strike the goalie in regions other than the chest. If these prior art protectors where provided with extra body area coverage, it would only add to their already excessive bulk and weight.

SUMMARY OF THE PRESENT INVENTION

The present invention provides a sports useable body protector which is extremely light in weight and maneuverable particularly when considering the body area covered by the protector. Furthermore, the addition of increased body area coverage, because of the design of the protector of the present invention, adds very little to its weight.

More particularly, the body protector of the present invention is built around a rigid plastic frame with forward padding and a rearward suspension strap on the frame. The rigid frame is formed with rearwardly extending wrap around rib covering portions and wrap over collar bone and shoulder covering portions, and all of which are shaped to pull the rigid frame rearwardly such that the suspension strap is snug against a user with the rigid frame in a tight body fitting position.

Through the use of a rigid plastic frame, only a relatively small amount of additional padding is required to absorb impacts on the body protector. Furthermore, as a result of the wrap around rib covering portions and the wrap over collar bone and shoulder covering portions, there is additional body area coverage provided by the protector and these portions act as means for providing a snug fit of the protector which substantially enhances ones maneuverability while wearing the protector.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
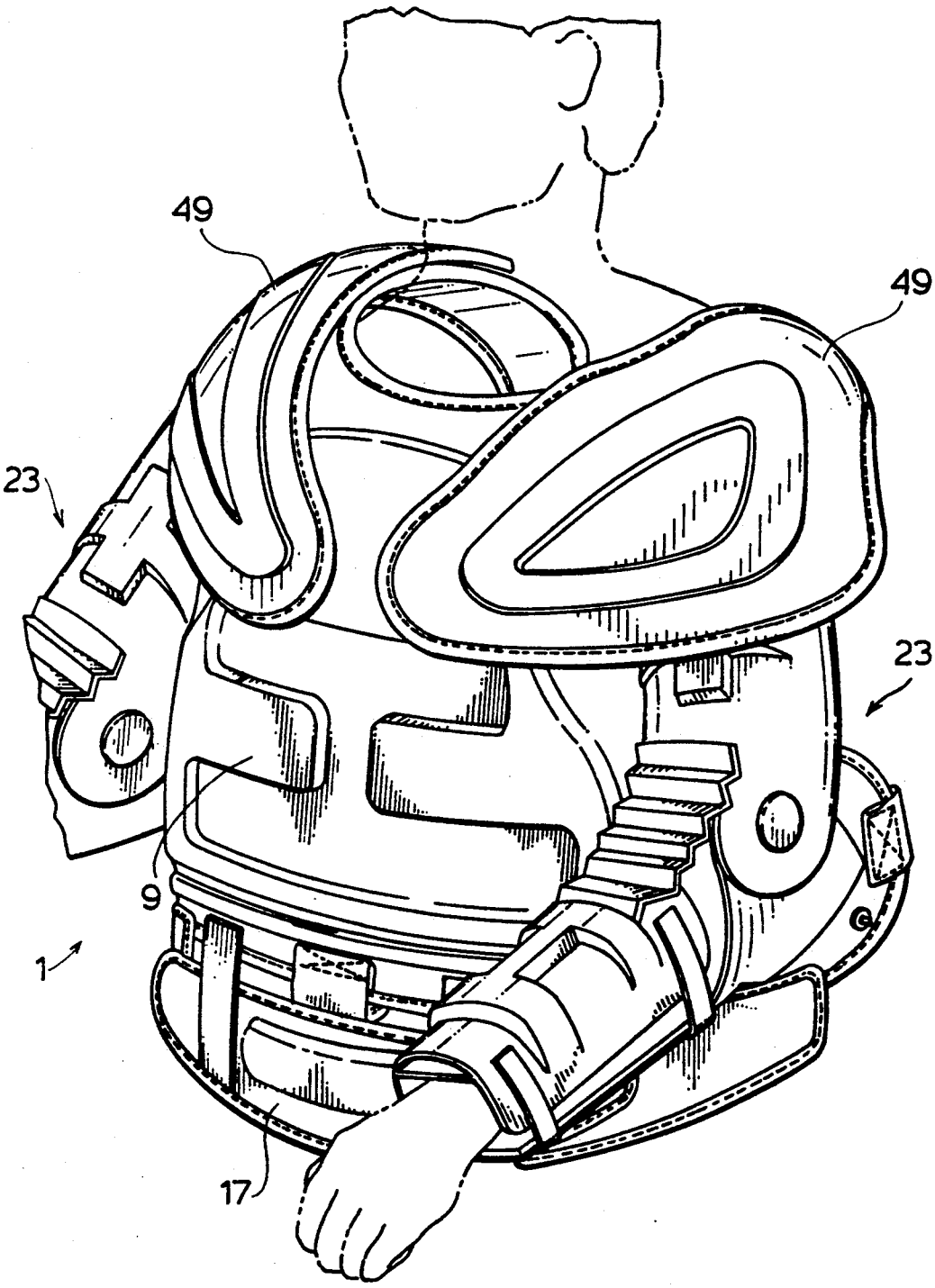
FIG. 1 is a perspective view of a body protector according to a preferred embodiment of the present invention and shown as worn by a user of the protector.

FIG. 1 shows a body protector and more particularly a hockey goalie body protector generally indicated at 1. The prime feature of this body protector is the inclusion of a rigid plastic frame 3, best seen in FIGS. 2 and 3 of the drawings, around which the body protector is built. The plastic frame is preferably made from high density polyethylene non-stress relieved plastic. This frame construction is extremely impact resistant even at low temperatures.

One of the key elements of the frame is in its formation where the frame includes upper end wrap over frame portions 5 and side wrap around frame portions 7. Not only do portions 5 cover the collar bone and shoulder region while the wrap around portions 7 cover the ribs of the user but in addition, all of these portions contribute to the holding of the protector in a tight body fitting position against the user.

Figure 2:
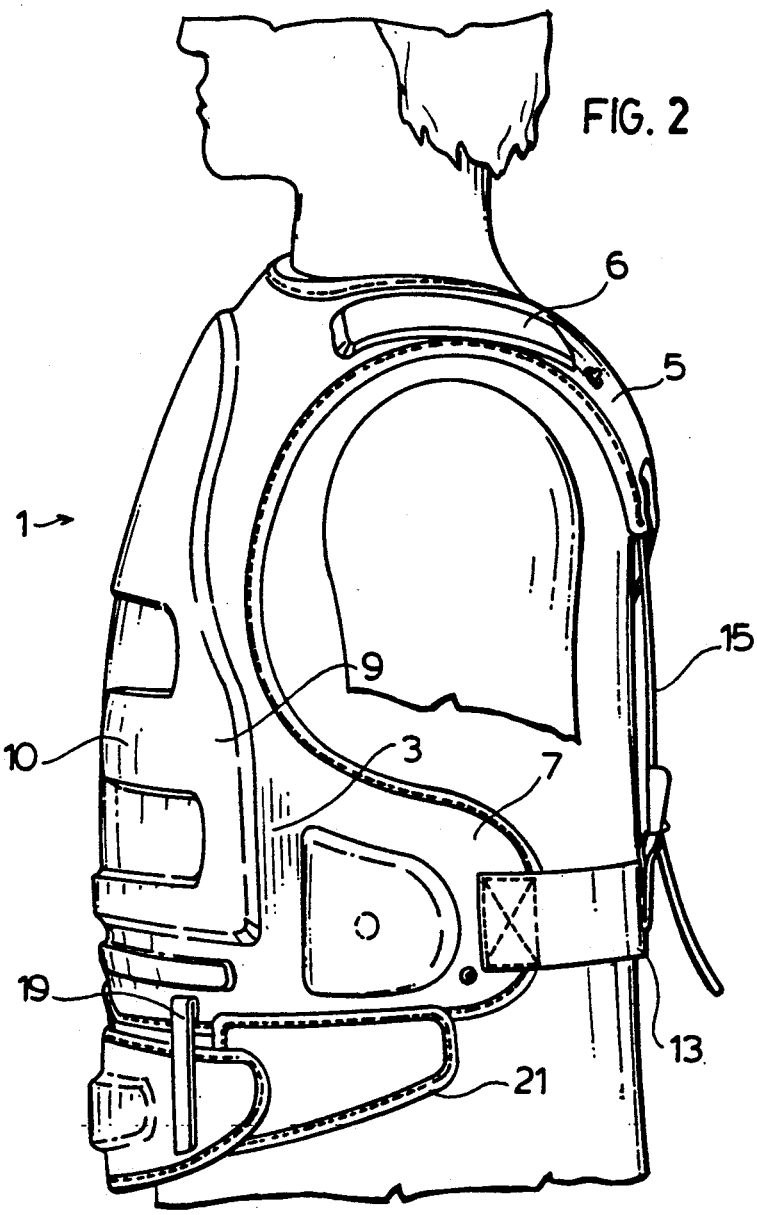
FIG. 2 is a side view of the main chest protector portion of the body protector of FIG. 1.
Figure 3:
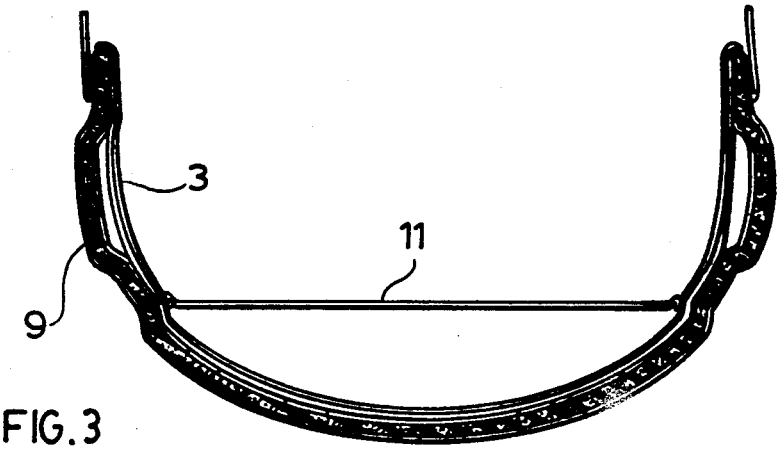
FIG. 3 is a sectional view looking down through the chest protector portion of FIG. 2.

More particularly, the body protector includes a suspension strap 11 to its inner side as shown in FIG. 3 of the drawings. With the collar bone and shoulder covering portions 5, as well as the rib covering portions 7 wrapped around the body as shown in FIG. 2, they pull the entire protector rearwardly such that suspension strap 11 is in a taut or snug position around the body of the user. The suspension strap acts as a buffer to prevent direct contact of the frame against the body although the overall protector is in a snug fitting position for ease of maneuverability and allowing ones arms to move easily across the front of the protector without jostling its position. This snug fit which includes body coverage areas over and above the chest, is different from prior art chest protectors.

In order to properly secure the protector in position and snug up the fitting, it is provided with cooperative fastening means in the form of a strap 13 secured to rib covering portions 7 and straps 15 secured to collar bone and shoulder covering portions 5 of the frame. The straps 13 and 15 are adjustable to pull frame portions 5 and 7 tightly against the body which in turn results in the tight fitting of suspension strap 11 to the front of the user.

The main frame 3 of the protector is padded to both its outer and inner or forward and rearward surfaces preferably using a waterproof closed cell expanded polyethylene foam. The foam is then covered by a tear resistant material such as nylon or the like. FIGS. 1 through 4 of the drawings show padding 9 applied to the front of frame 3. This padding is formed with a rib construction 10 which dampens the impact of a puck on the front of the protector which not only protects the user but which additionally reduces rebounds and deflections off of the protector. This is particularly important to a hockey goalie where a puck impacting the protector should drop down as close as possible to the goalie.

Figure 4:
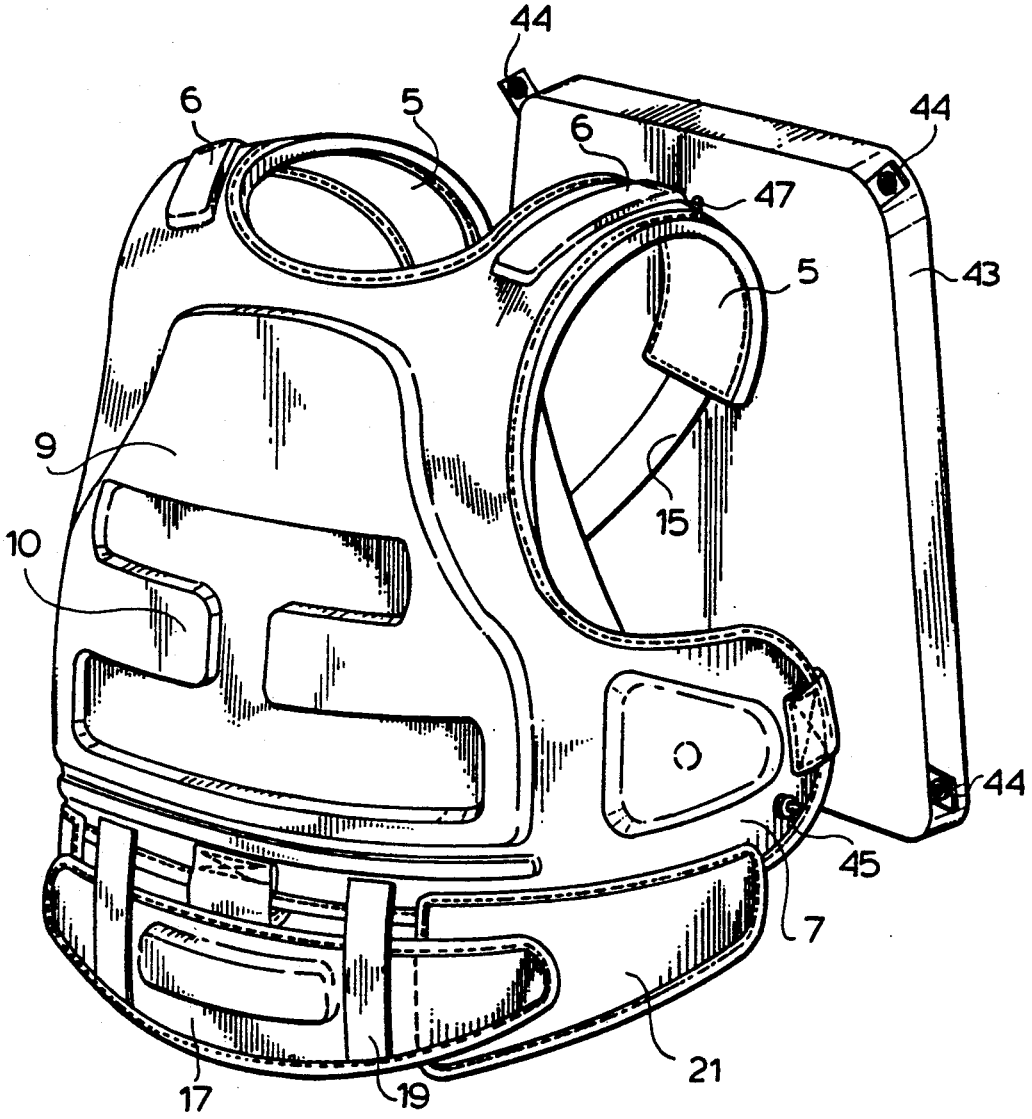
FIG. 4 is a perspective view of the chest protector of FIG. 2 and additionally fitted with a back pad.

For added protection purposes, the upper side of the collar bone and shoulder covering portions 5 is also provided with extra padding 6 as best seen in FIGS. 2 and 4 of the drawings.

Body protector 1 in the preferred embodiment further includes a downwardly hanging stomach protector portion 17 again having a plastic and foam padded construction. The stomach protector portion is secured to the main chest protector portion by means of flexible straps 19 which allow the goalie to bend down while the stomach protector moves out of the way so as not to inhibit the bending action.

Additionally provided are kidney guards 21 removably and flexibly secured to protector 1 to complete the coverage for the stomach and kidney area.

As added protection, protector 1 further includes arm protector portions generally indicated at 23 and additional shoulder pads 49. These shoulder pads again have a plastic and foam construction as earlier described.

FIG. 4 shows the body protector as additionally including a back pad 43 which has snap fasteners 44 secureable to complimentary snap fasteners 45 and 47 provided on rib covering portions 7 and collar bone and shoulder covering portions 5 respectively. Back pad 43 fits directly over the securing straps 13 and 15 to prevent injuries, if for example the goalie backs up into the net or falls to a position where the goalie's back may be exposed.

Figures 5, 6, 7:
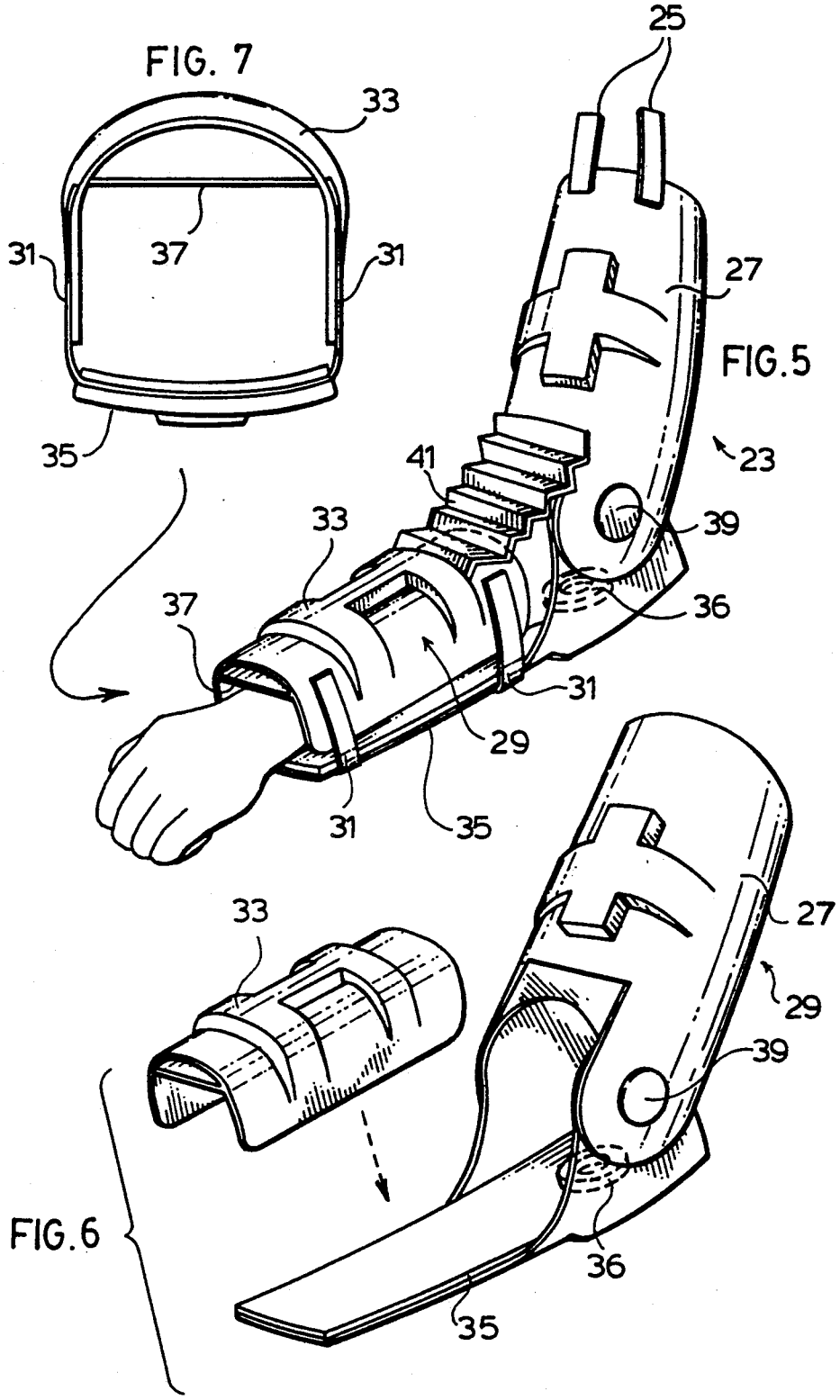
FIG. 5 is a perspective view of the arm protector portion of the body protector of FIG. 1.
FIG. 6 is a partially assembled perspective view of the forearm portion of the arm protector of FIG. 5.
FIG. 7 is a sectional view through the forearm protector portion from the arm protector of FIG. 5.
Figure 8:
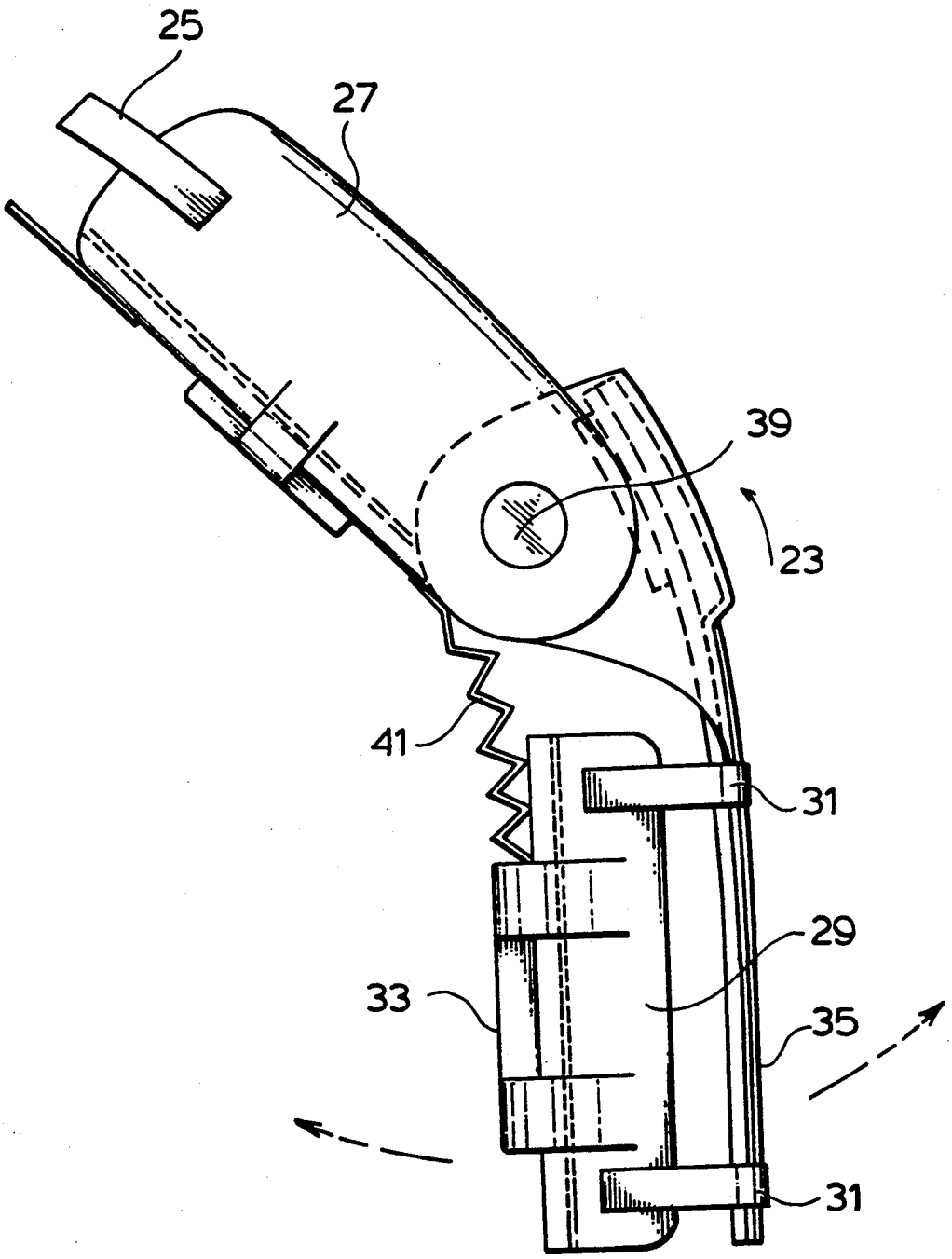
FIG. 8 is a side view of the arm protector of FIG. 5.

The design for the arm protector portions 23 is best seen having reference to FIGS. 5 through 7 of the drawings. Again, each of these arm protector portions is built around a rigid lightweight impact resistant plastic frame.

More particularly, each of the arm protector portions 23 comprises an upper arm portion 27 and a lower or forearm portion 29. Each arm protector portion 23 is secured to the main body protector by means of flexible straps 25 allowing relatively unrestricted movement of the arm protector portion.

The upper arm portion 27 is secured to the forearm portion 29 by a hinge connection 39 which allows relative movement between these two portions.

The forearm protector portion 29 is formed by a lower or base plastic piece 35 which includes an elbow seat 36. A cover plate 33 is secured to the base piece 35 by means of straps 31 which allows an initial fitting of the arm on base piece 35 after which cover piece 33 is secured in position. Each of the cover pieces 33 again includes a suspension piece or strap 37 which helps to absorb impacts received on the forearm protector.

As earlier described, upper arm portion 27 and forearm portion 29 are hingedly connected to one another. In order to cover the forward hinge area, the arm protector further includes an expansion hinge cover piece 41 best seen in FIG. 5 of the drawings. This cover piece again allows unrestricted bending of portions 27 and 29 while blocking impacts at the joint. Also the arm protector is open beneath cover piece 41 allowing ventillation to both the foream and the upper arm while wearing the protector.

It will now be seen from the description above that the present invention provides an extremely lightweight, snug fitting body protector with a substantial body coverage area. It is to be appreciated that not all of the body coverage areas be used at one time, where for example, the arm protectors, the back pad, the kidney pads and the additional shoulder pads need not be fitted to the main chest protector.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A sports goalie protector comprising a rigid frame with a frontal portion and wrap around side portions, said frame having an inside surface and an outside surface, said outside surface being padded and said inside surface being fitted with a suspension strap extending across said frame between said wrap around side portions and spaced behind said frontal portion of said frame, said frame further including wrap over collar bone and shoulder covering portions for direct body contact with a user of said protector.

2. A body protector as claimed in claim 1, including arm guards flexibly secured to said protector, said arm guards including upper arm and forearm fitting portions connected to one another by a covered hinge.

3. A body protector as claimed in claim 2, wherein said forearm fitting portions include suspension members.

* * * * *